US009821238B1

(12) United States Patent
Wood et al.

(10) Patent No.: US 9,821,238 B1
(45) Date of Patent: Nov. 21, 2017

(54) BUBBLE GENERATING POOL TOY

(71) Applicants: Blake Wood, Collinsville, OK (US); Deeann Wood, Collinsville, OK (US)

(72) Inventors: Blake Wood, Collinsville, OK (US); Deeann Wood, Collinsville, OK (US)

( * ) Notice: Subject to any disclaimer, the term of this patent is extended or adjusted under 35 U.S.C. 154(b) by 0 days.

(21) Appl. No.: 15/369,063

(22) Filed: Dec. 5, 2016

Related U.S. Application Data

(60) Provisional application No. 62/277,164, filed on Jan. 11, 2016.

(51) Int. Cl.
*A63H 23/10* (2006.01)
*A63H 31/00* (2006.01)

(52) U.S. Cl.
CPC ..... *A63H 23/10* (2013.01)

(58) Field of Classification Search
CPC ..... A63H 23/00; A63H 23/10; A63H 23/12; A63H 33/00; A63H 33/28; A63G 31/00; A63G 31/007; F41B 7/00; F41B 7/08
USPC ..... 446/15–18, 26–28, 153; 472/128
See application file for complete search history.

(56) References Cited

U.S. PATENT DOCUMENTS 4,768,774 A * 9/1988 Beasley ..... A63B 21/0084 441/129
5,042,819 A * 8/1991 LaFata ..... A63H 33/28 273/349
5,207,499 A 5/1993 Vajda et al.
5,890,942 A 4/1999 Souza-Ferreira et al.
5,930,851 A 8/1999 Brunelle
6,119,286 A 9/2000 Briscoe
6,482,058 B2 * 11/2002 Sanso ..... A63B 67/007 440/101
6,786,251 B2 9/2004 Nadel et al.
8,490,831 B1 7/2013 Wong et al.
8,926,392 B2 * 1/2015 Strong ..... B65D 25/28 446/197
2011/0059675 A1 * 3/2011 Liebling ..... A63H 23/10 446/153

* cited by examiner

*Primary Examiner* — Kien Nguyen
(74) *Attorney, Agent, or Firm* — Millikin McKay PLLC

(57) ABSTRACT

The present invention is a bubble generating pool toy that generates air bubbles in a swimming pool in response to movement of levers provided on the toy. The toy is used by positioning it behind a user's back and grasping two levers which extend from each side of the toy. By repeated pushing the levers sideward away from each other in front of the user's chest and then allowing the levers to once again come together in front of the user's chest under the power of bellows that are outwardly biased, the bellows provided on the toy are alternately expanded and compressed. Expansion and compression of the bellows causes air to be pulled downward through tubes fitted with one-way valves and forces the air to exit the toy via bubble stones located under the surface of the water in the swimming pool, creating air bubbles in the water.

6 Claims, 5 Drawing Sheets

BUBBLE GENERATING POOL TOY

CROSS-REFERENCE TO RELATED APPLICATIONS

The present application claims priority to U.S. Provisional Patent Application Ser. No. 62/277,164 filed on Jan. 11, 2016 for Bubble Generating Pool Toy.

BACKGROUND OF THE INVENTION

1. Field of the Invention

The present invention is a bubble generating pool toy that generates air bubbles in a swimming pool in response to movement of levers provided on the toy. The toy is used by positioning it behind a user's back and grasping the two handles or levers which extend from each side of the toy. By repeated pulling the levers together in front of the user's chest and then pushing the lever's sideward so that the levers move away from each other, bellows provided on the toy cause air to be pulled downward through tubes fitted with one-way valves and force the air to exit the toy via bubble stones located under the surface of the water in the pool, creating air bubbles in the water.

2. Description of the Related Art

Bubble machines are often used to generate soap bubbles in the atmosphere to create a festive attraction. Also, fish tanks employ air pumps to create bubbles in the water of the fish tanks to keep the water oxygenated. Additionally, bathtubs are often equipped with pumps that create air bubbles within water jets within the tub for massaging tired muscles of a bather.

The present invention is designed as a toy to use in a swimming pool as a means of creating air bubbles in the water of the pool.

SUMMARY OF THE INVENTION

The present invention is a toy to use in a swimming pool for creating air bubbles in the water of the pool. The invention is designed to be placed behind a user's back when the user is in the water of a pool. The invention is provided with a pair of bellows that are compressed by use of levers that are grasped by the user. The bellows are normally expanded which causes the levers of the toy to be positioned toward each other. In this position, the attached bellows cause a suction within central passageways of the toy that are located at the back of the toy, causing air to be pulled into the central passageways from atmosphere via a first set of one-way intake valves. Then as the user moves the levers away from each other, the attached bellows cause the central passageways to pressurize. Pressurization of the central passageways causes the first set of one-way intake valves to close and causes a second set of one-way discharge valves to open to expel the air from the central passageways through the second set of one-way discharge valves. The second set of one-way discharge valves are located underwater when the user is located in the pool. Bubble stones may be provided on the discharge end of the second set of one-way discharge valves to cause the air discharging from the second set of one-way discharge valves to create a plurality of small bubbles in the water of the pool.

The arrangement and location of the various one-way valves may be varied to make the toy operate most effectively.

In an alternate arrangement, the toy can be constructed so that the levers are pushed away from each other when the bellows are expanded and the bellows are compressed by pulling the levers toward each other.

It may also be desirable to include floatation devices on the first set of one-way intake valve so that they float and remain above water when in use.

In a second alternate arrangement, the two discharge tubing can be functionally joined together downstream of the second set of one-way discharge valves to form a single discharge tube that can then feed one or more bubble stones. This arrangement will allow air to be pushed through multiple bubble stones when pumping with only one lever.

DETAILED DESCRIPTION OF THE PREFERRED EMBODIMENT

Figure 1:
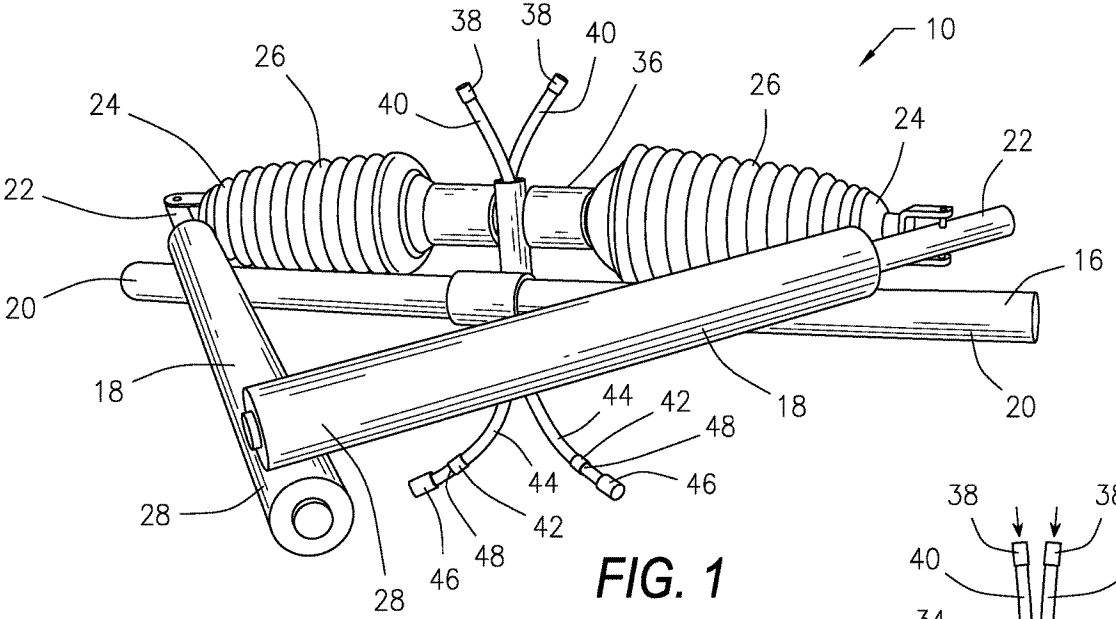
FIG. 1 is perspective view of a bubble generating pool toy that is constructed in accordance with a preferred embodiment of the present invention.
Figure 2:
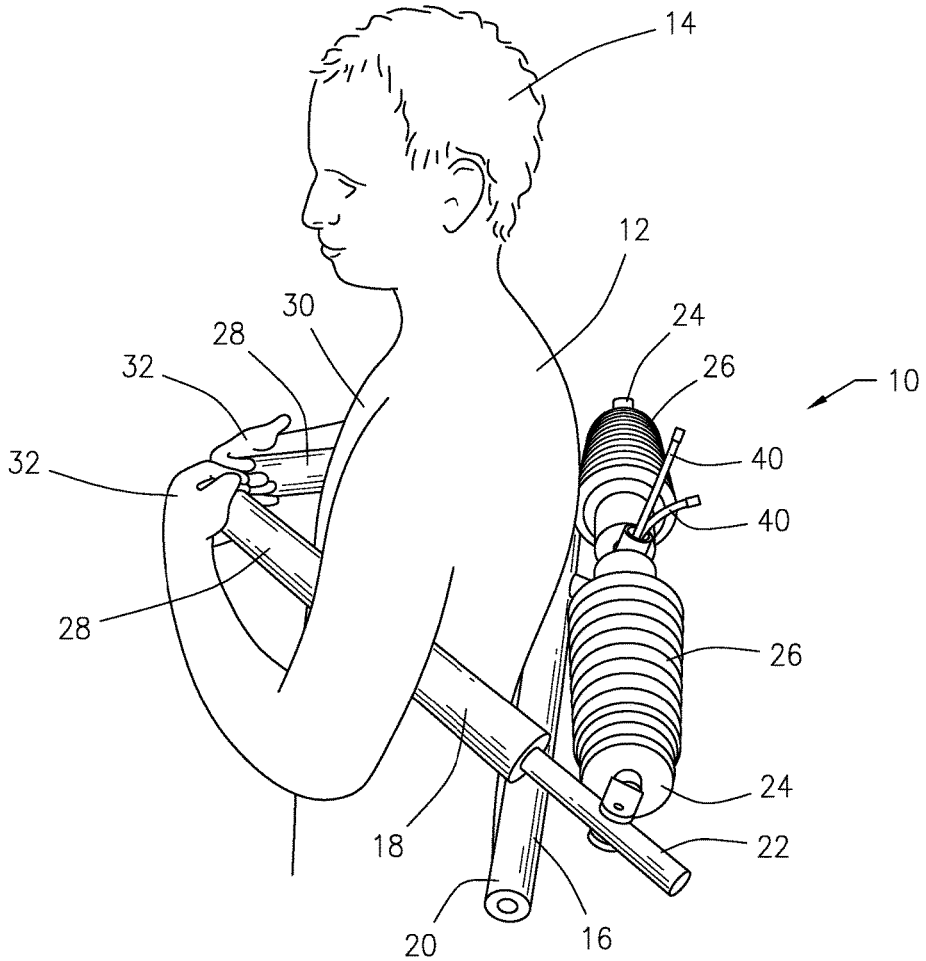
FIG. 2 is a side view of the bubble generating pool toy of FIG. 1 shown in use by a person.

Referring now to the drawings and initially to FIG. 1, there is illustrated a pool toy 10 for use in a swimming pool to create air bubbles in the water of the pool. As shown in FIG. 2, the toy 10 is designed to be placed behind a back 12 of a user 14 when the user 14 is in the water of a pool. The toy 10 has a back support 16 to which a pair of levers 18 is attached so that one lever 18 is located at each end 20 of the back support 16 and is pivotally attached to the back support 16. One end 22 of each lever 18 extends rearward and is attached to a distal end 24 of one of a two compressible bellows 26, and an opposite handle end 28 of each lever 18 extends forward so that it extends in front of a chest 30 of a user 14 and can be grasped by the hands 32 of a user 14.

Figure 4:
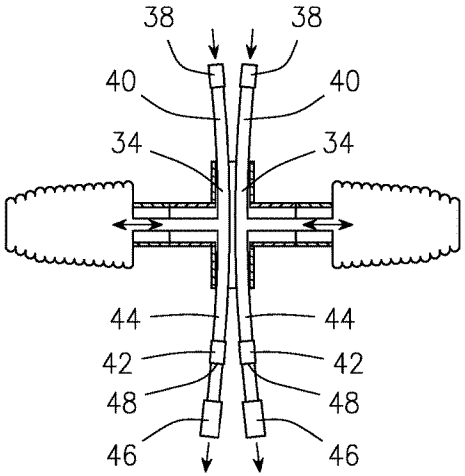
FIG. 4 is a diagram of the central passageways of the toy showing the relationship of the bellows, the central passageways, the intake valves and discharge valves.
Figure 3:
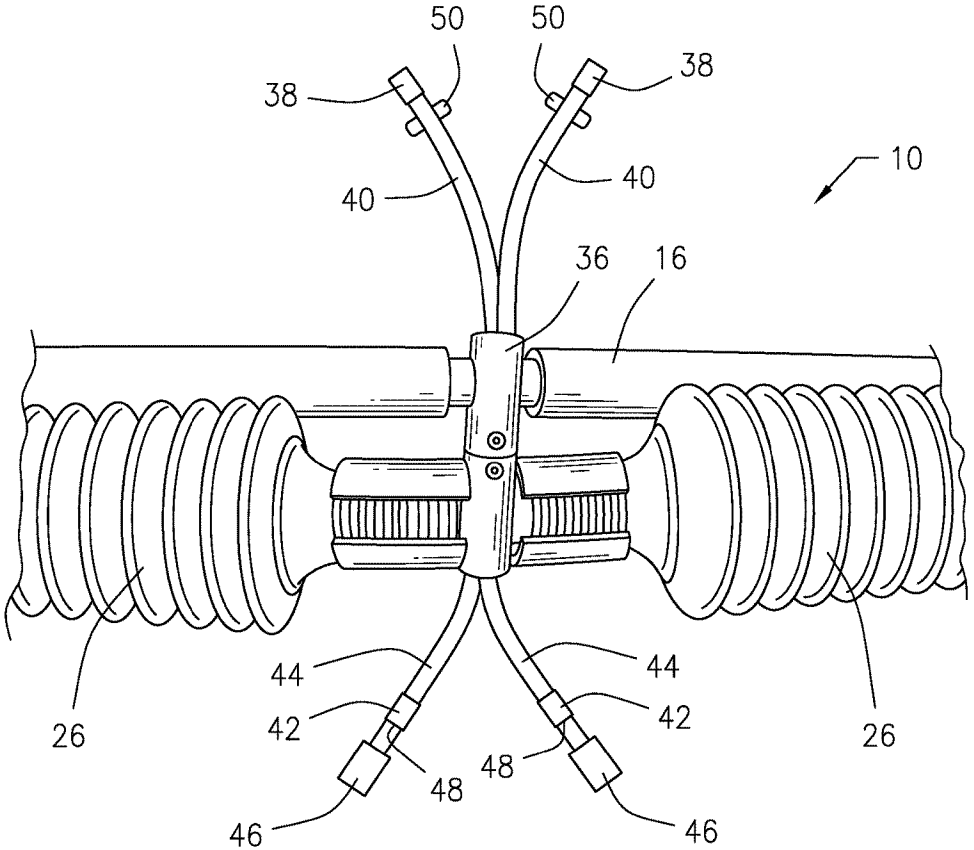
FIG. 3 is a partial rear view of the bubble generating pool toy of FIG. 1 showing the central portion of the toy where the central passageways of the toy are located.

Referring also to FIGS. 3 and 4, use of the toy 10 will be described. The user 14 moves the levers 18 to generate bubbles in the water. Bellows 26 attached to the levers 18 push the levers together or toward each other. As shown in FIG. 2, in this position, the attached bellows 26 are extended outward and this causes suction to be created within central passageways 34 of the toy 10 that are located at the back side 36 of the toy 10. This suction causes air to be pulled into the central passageways 34 from atmosphere via a first set of one-way intake valves 38 that attach to the central passageways 34 via intake tubing 40.

Then as the user 14 pushes the levers 18 away from each other, the attached bellows 26 are compressed and this causes the central passageways 34 to pressurize. Pressurization of the central passageways 34 causes the first set of one-way intake valves 38 to close and a second set of one-way discharge valves 42 to open. This causes air located within the central passageways 34 to be expelled through the second set of one-way discharge valves 42 via discharge tubing 44 that connects the second set of one-way discharge valves 42 to the central passageways 34. The second set of one-way discharge valves 42 are located underwater when the user 14 is located in the pool, and thus the air being discharge creates bubbles in the water. Once pressure is released on the levers 18, the bellows 26 expand outward. This causes the levers 18 to once again move toward each other, causes the second set of one-way discharge valves 42 to close, causes the first set of one-way discharge valves 38 to open, and causes air to be pulled into the central passageways 34 via the now open first set of one-way intake valves 38.

It may be desirable to attach bubble stones 46 on a discharge end 48 of the second set of one-way discharge valves 42 to cause the air discharging from the second set of one-way discharge valves 42 to pass through the bubble stones 46 to create a plurality of small bubbles in the water of the pool.

It is obvious that the one way intake valves 38 could be switched in location with the one-way discharge valves 42 to make an alternate toy which would pull water upward into the central passageways 34 and then discharge that water upward into the air via the discharge valves 42.

The arrangement and location of the various one-way valves 38 and 42 may be varied to make the toy 10 operate most effectively. For example, it may be desirable to locate the first set of one-way intake valves 38 in various locations in the intake tubing 40 or may be desirable to locate the second set of one-way discharge valves 42 in various locations in the discharge tubing 44.

As illustrated in FIG. 3, it may also be desirable to include floatation devices 50 on the first set of one-way intake valves 38 or on the intake tubing 40 so that they float and remain above water when in use.

Figure 5:
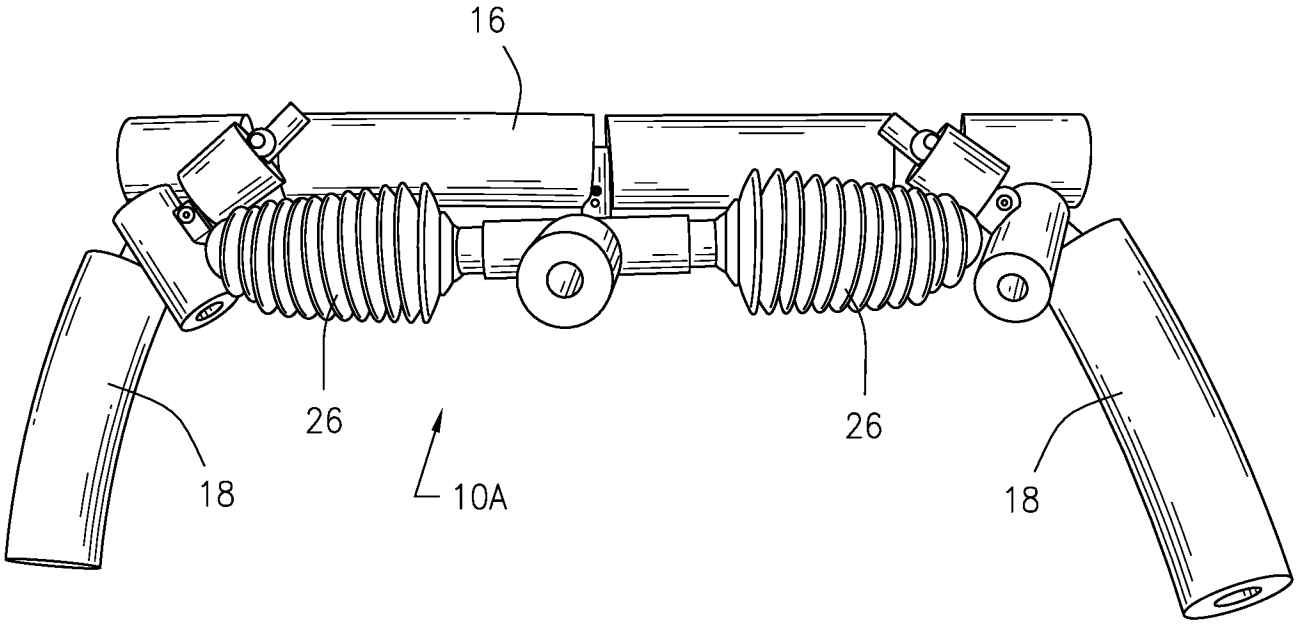
FIG. 5 is a top plan view of a first alternate toy shown with only the billows, levers and back support being illustrated.

Referring now to FIG. 5, there is illustrated a first alternate toy 10A. This first alternate toy 10A is constructed so that the levers 18 are pushed away from each other when the bellows 26 are expanded and the bellows 26 are compressed by pulling the levers 18 toward each other.

Figure 6:
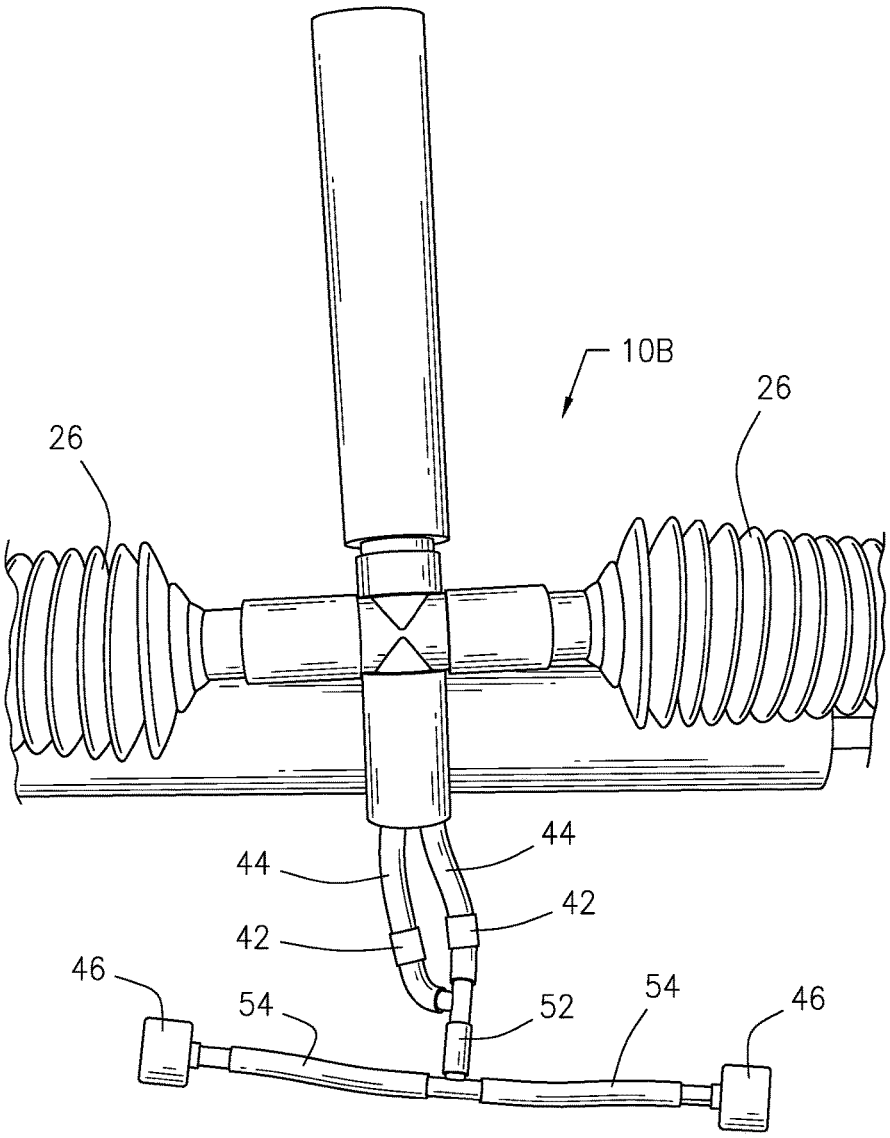
FIG. 6 is a partial rear view of the toy of FIG. 1 shown with a second alternate arrangement of the discharge tubing.

Referring to FIG. 6, in a second alternate arrangement of toy 10, the two separate discharge tubing 44 can be functionally joined together downstream of the second set of one-way discharge valves 42 to form a single discharge tube 52 that can then be split into multiple secondary discharge tubes 54 to feed more than one bubble stone 46. This arrangement will allow air to be pushed through multiple bubble stones 46 when pumping with only one lever 18.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A bubble generating pool toy comprising:

a back support, at least one bellow secured to the back support, a lever functionally attached to each bellow so that movement of the lever compresses and expands the bellow, tubing functionally attached to the bellow, said tubing having an intake end for taking in air when the bellow expands and a discharge end for discharging air when the bellow compresses, a one way intake valve secured in the intake end of the tubing, a one way discharge valve secured in the discharge end of the tubing, and a bubble stone secured to the discharge end of the tubing and located downstream of the discharge valve.

2. A bubble generating pool toy according to claim 1 further comprising:

a floatation device provided on the intake end of the tubing to hold the intake end above water when in use in a pool.

3. A bubble generating pool toy comprising:

a back support, two bellows secured to the back support, a lever functionally attached to each bellow so that movement of the lever compresses and expands the attached bellow, separate tubing functionally attached to each bellow, each said tubing having an intake end for taking in air when the attached bellow expands and having a discharge end for discharging air when the attached bellow compresses, a one way intake valve secured in the intake end of each tubing, a one way discharge valve secured in the discharge end of each tubing, and a bubble stone secured to the discharge end of each tubing such that the bubble stones are located downstream of the discharge valves.

4. A bubble generating pool toy according to claim 3 further comprising:

a floatation device provided on the intake end of the tubing to hold the intake end above water when in use in a pool.

5. A bubble generating pool toy comprising:

a back support, two bellows secured to the back support, a lever functionally attached to each bellow so that movement of the lever compresses and expands the attached bellow, separate tubing functionally attached to each bellow, each said tubing having an intake end for taking in air when the attached bellow expands and having a discharge end for discharging air when the attached bellow compresses, a one way intake valve secured in the intake end of each tubing, a one way discharge valve secured in the discharge end of each tubing, and said discharge end of each tubing attached to a common single discharge tube downstream of said discharge valves, said common single discharge tube attached to multiple secondary discharge tubes, and a bubble stone secured to the discharge end of each on said multiple secondary discharge tubes such that the bubble stones are located downstream of the common single discharge tube.

6. A bubble generating pool toy according to claim 5 further comprising:

a floatation device provided on the intake end of the tubing to hold the intake end above water when in use in a pool.

* * * * *